United States Patent [19]

Brame

[11] Patent Number: 4,725,286

[45] Date of Patent: Feb. 16, 1988

[54] FIRESTARTER

[76] Inventor: Dorothy H. Brame, 517 State St., Greensboro, N.C. 27405

[21] Appl. No.: 942,982

[22] Filed: Dec. 16, 1986

Related U.S. Application Data

[63] Continuation-in-part of Ser. No. 932,580, Nov. 20, 1986, abandoned.

[51] Int. Cl.[4] ..... C10L 11/06; C10L 11/00

[52] U.S. Cl. ..... 44/38; 44/41

[58] Field of Search ..... 44/38, 41, 34, 1 D, 44/10 B

[56] References Cited

U.S. PATENT DOCUMENTS

| | | | |
|---|---|---|---|
| 170,158 | 11/1875 | Cushing | 44/41 |
| 2,107,054 | 2/1938 | Haymond | 44/41 |
| 2,811,428 | 10/1957 | Smith | 44/41 |

FOREIGN PATENT DOCUMENTS

| | | | |
|---|---|---|---|
| 3239154 | 5/1984 | Fed. Rep. of Germany | 44/10 B |
| 6382 | of 1905 | United Kingdom | 44/41 |
| 22057 | of 1906 | United Kingdom | 44/34 |
| 111248 | 11/1917 | United Kingdom | 44/41 |
| 631868 | 11/1949 | United Kingdom | 44/41 |
| 2377 | 8/1967 | United Kingdom | 44/38 |

*Primary Examiner*—Carl F. Dees

*Attorney, Agent, or Firm*—Clifton Ted Hunt

[57] ABSTRACT

The firestarter comprises a wax and wood base and a wick protruding from the base. The wood is compressed wood fragments from which the natural oil has been removed, and these fragments are mixed with melted wax in substantially equal portions. A flammable structure such as a pine cone is dipped in wax and seated in the base in an upright position to add intensity to the flame and to provide an upward conduit for the flame from the base in use.

6 Claims, 6 Drawing Figures

FIRESTARTER

CROSS-REFERENCE TO OTHER APPLICATIONS

This application is a continuation in part of application Ser. No. 932,580 filed Nov. 20, 1986, for FIRESTARTER now abandoned.

FIELD OF THE INVENTION

The firestarter of this invention finds utility as an igniter for logs in fireplaces and woodstoves. It may also be used as an igniter for charcoal briquettes and other material to be burned.

BACKGROUND OF THE INVENTION

The use of sawdust in a firestarter has long been known. See, for example, U.S. Pat. No. 697,014 issued Apr. 8, 1902, to Alfred F. Putnam for FIRE-KINDLER AND METHOD OF MAKING. Putnam uses coarse resinous sawdust and finely pulverized resin thoroughly mixed together and heated to about 300 degrees F. After cooling, the mixture is placed in a mold and subjected to sufficient pressure to reduce the mixture to about one-half its original proportions and form a brick-shaped block.

U.S. Pat. No. 4,046,518 issued Sept. 6, 1977, to Charles J. Daizell for SOLID FUEL ELEMENT AND PROCESS OF MANUFACTURING uses fine sawdust obtained from compressed wood blended with an equivalent amount of liquid wax at a sufficiently elevated temperature to release substantially all moisture from the sawdust and saturate the compressed wood particles with wax. The hot blended material is cooled and compacted into small blocks. Daizell uses temperatures up to 350 degrees F. to rid the sawdust of moisture and saturate it with a special wax. Daizell is only interested in driving off the moisture from the special compressed sawdust, and does not suggest the need or desirablility of eliminating oil from the sawdust derived from compressed wood. The blend is cooled and then compacted under a pressure of approximately 22,000 p.s.i. to form a dry solid fuel element or igniter.

It is also known in the prior art to use a pine cone on a base of melted paraffin or candle wax. Such a firestarter is described on page 47 of the publication entitled, *CHRISTMAS WITH SOUTHERN LIVING*, 1982, published by Oxmoor House, Inc., Birmingham, Alabama. The pine cone firestarter there described uses pine cones, paraffin or candle stubs, wicking, and coloring. The paraffin is melted, and each pine cone is dipped into the melted paraffin to completely coat the cones which are then allowed to cool. Melted paraffin is transferred into muffin cups and 1½" of wicking is inserted in the paraffin within each cup. Just before the paraffin hardens a cone is pressed into the paraffin in each cup. The paraffin is allowed to harden before removing it from the muffin cups and the prior art pine cone firestarter is complete.

U.S. Pat. No. 3,279,900 issued Oct. 18, 1966, to John Naples for RAPID IGNITION CHARCOAL PACKAGE AND METHOD 0F IGNITING is another example of using paraffin wax with a mixture of wood as a firestarter. The Naples firestarter is in the form of a package containing a mat of wax and wood particles about ½" thick and a supply of charcoal briquettes. Naples is not considered pertinent to the present invention other than its teaching of using wax and a wood product as a firestarter.

SUMMARY OF THE INVENTION

The firestarter of the preferred embodiment uses a base formed from substantially equal portions of paraffin wax and compressed fragments obtained from de-oiled cedar. The compressed cedar fragments bond better with the wax than ordinary cedar sawdust and the tightly bonded mixture burns with an intense heat and is completely combustible, leaving a minimum residue. Although the invention is described in terms of de-oiled cedar being used with the wax, it is within the spirit of the invention to use any de-oiled wood.

A pine cone or other upright structure is initially dipped in melted wax and subsequently positioned in the base of molten wax and compressed sawdust before the wax cools and hardens. A suitable scent and coloring may be added to the wax before or during heating, if desired. A length of wicking is positioned in the mold for the molten wax as it cools.

DETAILED DESCRIPTION OF THE INVENTION

Figure 1:
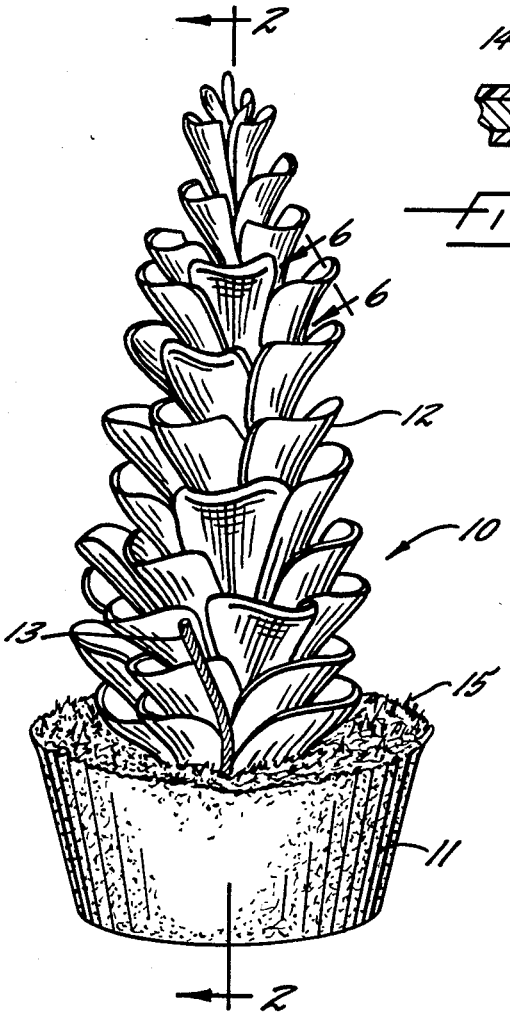
FIG. 1 is a perspective view of the firestarter.

The firestarter, broadly indicated at 10, comprises a base 11, a pine cone or other upright structure 12, and wicking 13.

The base 11 is a blend of substantially equal parts of ordinary paraffin wax 14 and de-oiled fragments of compressed cedar wood 15. Cedar is preferred because of its aroma, but wax will not adhere to normal, untreated cedar wood. It has been found that the oil in cedar wood breaks down or "melts" paraffin wax, but that wax will tightly adhere or bond to cedar wood which has been processed to remove the oil.

The de-oiled cedar wood used in this invention is a by-product of the derivation of cedar oil from cedar wood. The oil is squeezed from the wood by compressing slabs of cedar wood under pressure of 60 to 70 pounds per square inch to extract the oil. The slabs of cedar wood are fragmented into tiny pieces under the pressure required to extract the oil. The resulting wood fragments range in size from a speck to splinters longer than one inch and more than ¼ of an inch wide, and are substantially oil free. These oil free wood particles are referred to as "compressed cedar" in this description with the understanding that the compressed cedar is any kind of oil free wood particles of the random size described. The compressed cedar receives no further treatment before being mixed with the wax to form the base 11.

Figure 6:
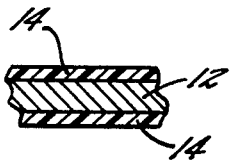
FIG. 6 is an enlarged sectional view taken substantially along the line 6—6 in FIG. 1.

The wax 14 is ordinary paraffin wax and the first step in making the firestarter 10 is to melt at a sufficient temperature a desired quantity of wax in one pot for use with the compressed cedar. Wax is melted in a second pot for dipping the pine cones. In actual practice, it has been found that the wax satisfactorily melts at a temperature of about 140 degrees F. While the wax is melting, coloring and fragrance may be added to it, if desired. The pine cones 12 are ordinary pine cones generally in the range of 4" to 6" in length and 1½" to 2½" in diameter. After the wax is melted, a supply of pine cones is dipped in the molten wax to coat the cones with a layer of wax (FIG. 6). The cones are then temporarily set aside while the wax hardens.

Substantially equal amounts of the melted wax and of the oil free compressed cedar fragments are mixed together until the wax is intimately bonded to each of the oil free wood fragments.

The mixture of melted wax and compressed wood fragments is then transferred into open topped molds. Muffin tins having a plurality of molds each measuring about 2 inches across the base and tapering upwardly about 1½ inches to an upper diameter of about 2½" across the top have been found satisfactory in use. The molten mixture is preferably poured to a depth of at least one inch in each of the molds.

Figure 2:
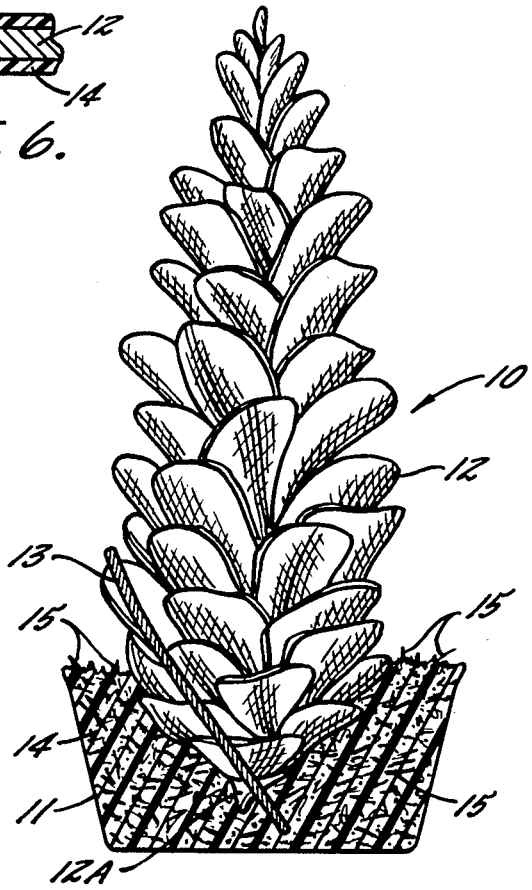
FIG. 2 is a sectional view taken substantially along the line 2—2 in FIG. 1.

The molten mixture of wax and compressed cedar is allowed to cool in the molds, but while still in a molten state the stem of one of the wax covered pine cones is pushed against the bottom of each mold. The pine cone floats in the molten wax compound so that there is a thin skin of the wax compound covering the stem of the pine cone in the finished product. The wicking 13 is also pressed into the molten wax compound after it has been poured in the mold. Each piece of wicking is about 2 inches long and is put in the molten wax compound in the mold before the cone. The lower portion 12A of the cone presses the wicking 13 toward the bottom of the mold and the wicking extends upwardly at an angle about the base or lower portion 12A of the cone (FIG. 2).

OPERATION

The finished product is illustrated in FIG. 1. In the illustrated embodiment, the firestarter 10 is placed closely adjacent or beneath fire logs 20 on an andiron 21 in a fireplace 22. Although the firestarter is illustrated as being used in a fireplace, it is to be understood that the firestarter may be used in any environment where it is desired to start a fire. It may be used, for example, in a woodstove or in an open camp fire. It is only necessary that the firestarter be placed in proximity to the fire logs or other material to be burned.

Figure 3:
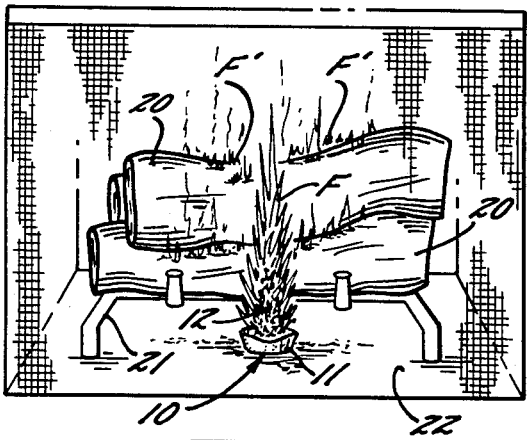
FIG. 3 is a perspective view of the firestarter positioned for use.

It is not necessary to use kindling or newspapers to build a fire with the firestarter of this invention because the firestarter burns with a sufficiently intense flame and for a long enough time to quickly ignite the firelogs. The special formula of the firestarter 10 burns with a clean blue blaze, eliminating smoking and reducing soot build-up caused by newspapers, fat wood, and other forms of pressed wood products containing their oils. FIG. 3 illustrates that the flame F from the firestarter 10 acts directly on the firelogs 20 to ignite them and cause them to burn with a flame $F^1$.

Figure 4:
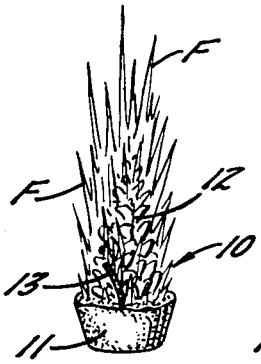
FIG. 4 is a perspective view similar to FIG. 1, but illustrating the flame that is produced shortly after the wick is lighted.

After the wick 13 is lighted by a match in the usual manner of lighting a candle, the burning wick first ignites the wax coated pine cone 12 to produce the flame F as shown in FIG. 4. The flame F quickly spreads to the wax-coated cone 12 and extends ten or twelve inches above the upper tip of the cone 12, or about 18 inches above the hearth. This feature of a high and intense flame is common to the prior art firestarter using a pine dipped cone in an all wax base, but it often happens that the all-wax base burns out before the firelogs ignite.

In contrast, the use of compressed cedar in the base of the present firestarter contributes to the longevity of the high and intense flame and its ability to quickly start a fire with ordinary natural firelogs.

FIG. 3 illustrates the firestarter after it has burned sufficiently to ignite the proximal upper and lower logs 20 and the flame F from the firestarter 10 continues to play against the upper logs after the firestarter has been burning long enough to partially consume the base 11.

FIG. 4 illustrates the flame 12 emanating from the firestarter after the wick has been lighted and its initial flame has ignited the wax coated cone.

Figure 5:
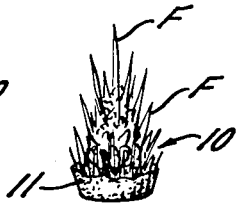
FIG. 5 is a perspective view of the firestarter similar to FIG. 4, but illustrating the flame that is produced after the base is approximately half consumed and the pine cone or other upright structure has burned away or is consumed.

FIG. 5 illustrates the height of the flame F after the pine cone 12 has been consumed. The base 11 is shown to be about half consumed and will continue to burn another fifteen or twenty minutes with a flame almost half as high as the maximum flame from the burning cone 12. The base 11 will continue burning for as long as 30 minutes because of the unique mixture of paraffin and de-oiled fragments of compressed cedar. When the base 11 is completely consumed by flame there is no wax residue remaining on the hearth because the wax is consumed in the burning of the wood.

There is thus provided a firestarter capable of burning with a long flame and capable of continuing to burn long enough to ignite natural wood logs without other kindling and leaving substantially no wax residue when the burning of the firestarter is complete.

Although specific terms have been used in describing the invention, they have been used in a generic and descriptive sense only and not for purpose of limitation.

I claim:

1. A firestarter comprising a base, a wick extending from the base, said base comprising paraffin wax and de-oiled wood fragments mixed together at an elevated temperature to bond the wax to the de-oiled wood, and a pine cone seated in the base and extending upwardly therefrom.

2. A firestarter according to claim 1 wherein the pine cone has been dipped in paraffin wax.

3. A firestarter according to claim 1 wherein scent and coloring are added to the wax.

4. A firestarter comprising a base of paraffin wax and de-oiled wood fragments, a pine cone seated in the base, and a wick extending from the base.

5. A method of making a firestarter comprising the steps of:

(a) providing a quantity of paraffin wax,
(b) providing a quantity of wood which has been compressed to remove the oil from the wood,
(c) melting the wax,
(d) adding the de-oiled wood to the melted wax,
(e) mixing the melted wax and de-oiled wook until the wax is tightly bonded to the de-oiled wood,
(f) transferring the mixture into a mold to form a base,
(g) providing a pine cone and seating it in an upright position in the base,
(h) allowing the base to cool, and
(i) removing the cooled base from the mold.

6. A method according to claim 5 which includes the steps of dipping the pine cone in melted wax and allowing the wax to cool before seating the pine cone in the base.

* * * * *